US005907336A

United States Patent [19]

Hayakawa

[11] Patent Number: 5,907,336

[45] Date of Patent: May 25, 1999

[54] INK JET RECORDING APPARATUS WITH INK DISCHARGE HOLE IN NONPRINT REGION

[75] Inventor: Hitoshi Hayakawa, Nagano, Japan

[73] Assignee: Seiko Epson Corporation, Tokyo, Japan

[21] Appl. No.: 08/694,292

[22] Filed: Aug. 8, 1996

[30] Foreign Application Priority Data

Aug. 11, 1995 [JP] Japan ..... 7-227216

[51] Int. Cl.[6] ..... B41J 2/165

[52] U.S. Cl. ..... 347/29; 347/30; 347/35

[58] Field of Search ..... 347/29, 30, 31, 347/35, 14, 23

[56] References Cited

U.S. PATENT DOCUMENTS

| | | | |
|---|---|---|---|
| 4,791,435 | 12/1988 | Smith et al. | 347/35 |
| 4,967,204 | 10/1990 | Terasawa et al. | 347/29 |
| 5,483,266 | 1/1996 | Nakamura | 347/23 |

FOREIGN PATENT DOCUMENTS

| | | | |
|---|---|---|---|
| 0 585 923 | 3/1994 | European Pat. Off. | B41J 2/165 |
| 0 589 581 | 3/1994 | European Pat. Off. | B41J 2/165 |
| 0585923 | 3/1994 | European Pat. Off. . | |
| 0608104 | 7/1994 | European Pat. Off. . | |
| 3-173653 | 7/1991 | Japan | B41J 2/165 |
| 6115097 | 4/1994 | Japan . | |

OTHER PUBLICATIONS

Patent Abstracts of Japan, vol. 017, No. 002 (M–1348), Jan. 5, 1993; & JP 04 235058 A (Canon Inc) Aug. 24, 1992; Abstract.

Patent Abstracts of Japan, vol. 015, No. 414 (M–1171), Oct. 22, 1991 & JP 03 173653 A (Seiko Epson Corp) Jul. 26, 1991; Abstract.

*Primary Examiner*—N. Le
*Assistant Examiner*—Thien Tran
*Attorney, Agent, or Firm*—Sughrue, Mion, Zinn Macpeak & Seas, PLLC

[57] ABSTRACT

An ink jet recording apparatus having a recording head for jetting ink droplets attached to a carriage 1 that reciprocates across the width of a recording medium and cap members 31, 32 for receiving ink droplets jetted for maintenance of the recording head during printing. To prevent banding and improve printing throughput, an ink discharge hole 35 having a window confronting the recording head is arranged in a nonprint region opposite to a side where the cap members 31, 32 are arranged and within a range of a locus of movement of the recording head. Discharging the ink from the cap members during printing for a single page can be dispensed with, and flashing is effected to the member 31 or 35 that is closer to the carriage.

2 Claims, 3 Drawing Sheets

INK JET RECORDING APPARATUS WITH INK DISCHARGE HOLE IN NONPRINT REGION

FIELD OF THE INVENTION

The invention relates to an ink jet recording apparatus that prints patterns on a recording medium by jetting ink droplets out of nozzle openings.

BACKGROUND OF THE INVENTION

Ink jet recording apparatuses typically employ recording heads that are designed to jet ink droplets out of nozzle openings. The jetting is caused by applying pressure to ink chambers using piezoelectric vibration elements or heating elements. In these apparatuses, measures must be taken to prevent the drying of the ink in the vicinity of the nozzle openings as well as impairment of the print quality due to dirt and dust deposits in the vicinity of the nozzles.

As one such measure, the recording head is moved to a capping device set in the standby position every time the print operation lasts a predetermined time, e.g., 20 seconds, so that ink droplets are jetted out of the nozzle openings into the capping device.

The ink discharged to the capping device this way is sucked into a discharge ink tank every time a predetermined amount of ink has been discharged by driving a pump connected to the capping device.

There are basically two types of systems for driving the ink discharge pump. One uses power from a dedicated drive motor, and the other uses the force of the print mechanism. By requiring a separate motor, the former system has the disadvantage of a larger overall system and a higher cost. On the other hand, the latter system can get pump driving power from the print mechanism drive source by employing a simple transmission mechanism, and therefore the latter system has a simpler structure that is highly reliable and less costly. However, the latter system requires that the print mechanism drive motor be reverse-driven to switch the print mode. In this situation, the shortcoming of banding can occur in printouts due to sheet forwarding errors if the transmission mechanism backlashes.

As a solution to these problems, the backlashes could be eliminated by inserting an elastic member, such as a spring, into the transmission mechanism. However, this approach is expensive.

SUMMARY OF THE INVENTION

The present invention has been made in view of the aforementioned circumstances. The object of the invention is therefore to provide an ink jet recording apparatus that can improve throughput while reducing the cost of manufacturing.

In order to achieve the above object, the invention is applied to an ink jet recording apparatus, which has a recording head for jetting ink droplets attached to a carriage that reciprocates across the width of a recording medium so that the recording head can be sealed in a nonprint region, and a cap member for receiving ink droplets to be jetted for maintenance of the recording head during printing. In addition, an ink discharge hole, having a window confronting the recording head, is arranged in a nonprint region that is opposite to the side where the cap member is arranged, and within the range of a locus of movement of the recording head.

Unlike the cap member, the ink discharge hole is not required to be a certain size in order to reliably seal the recording head. Therefore, the ink discharge hole can have a large capacity. As a result, the operation of sucking the ink out into the discharge ink tank is no longer necessary, nor is reverse rotation of the print mechanism drive motor required, which in turn eliminates backlash-caused errors due to reverse rotation of the sheet forwarding motor.

Further, by selecting and moving to either the cap member or the ink discharge hole as an ink receiving container, based upon the distance from the carriage to each, carriage moving time can be reduced to improve throughput.

DETAILED DESCRIPTION OF THE PREFERRED EMBODIMENT

Figure 1:
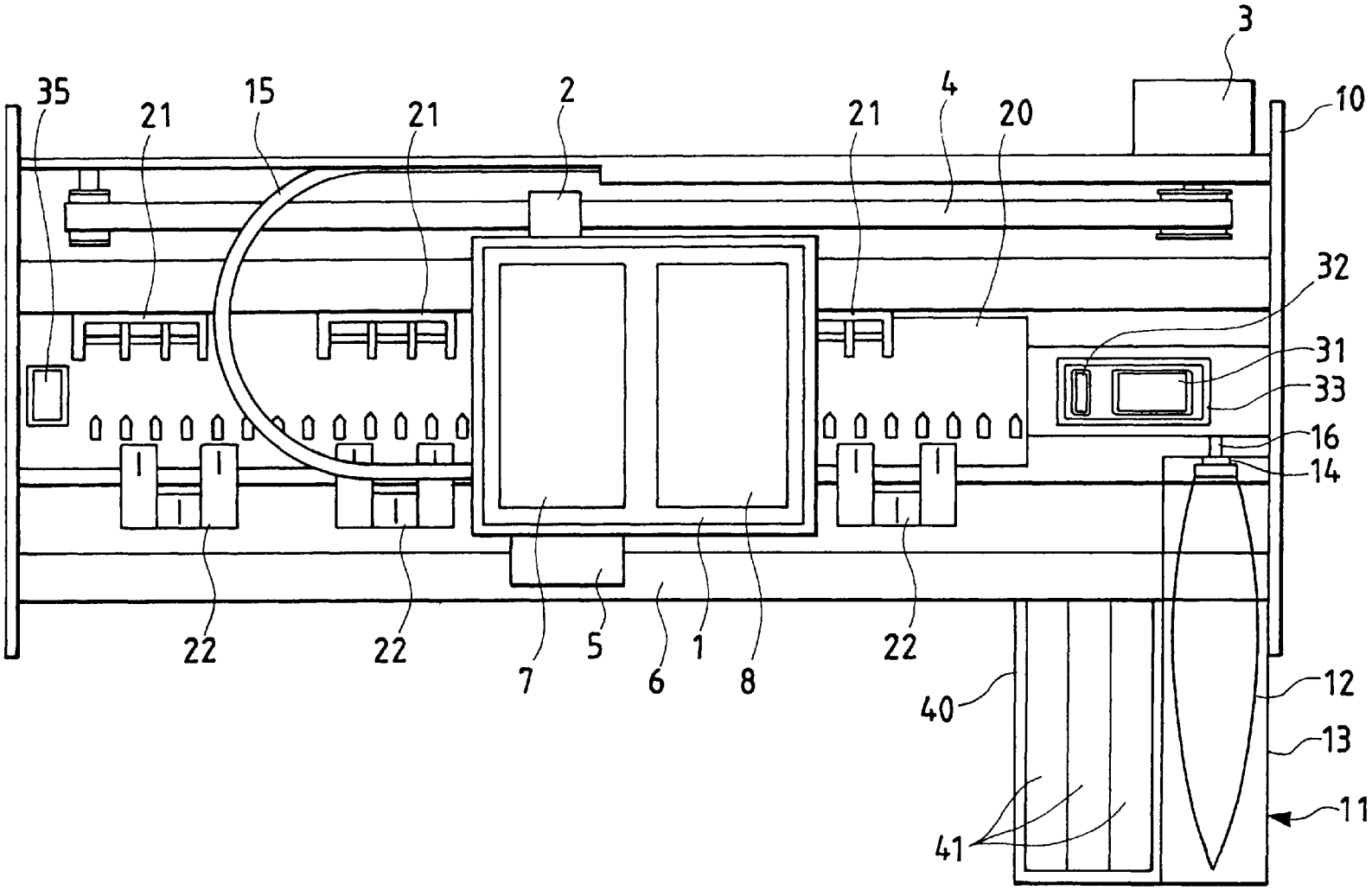
FIG. 1 is a plan view showing an embodiment of the invention.
Figure 2:
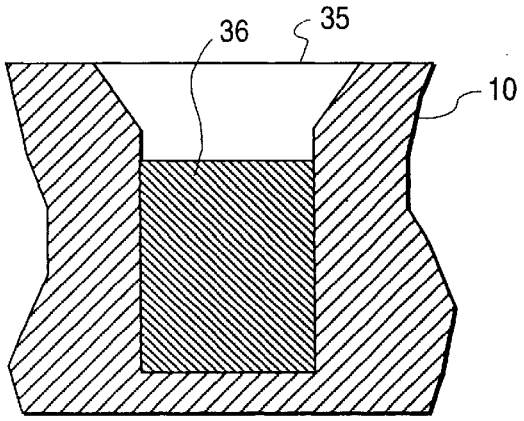
FIG. 2 is a sectional view showing an exemplary ink containing hole of the apparatus shown in FIG. 1.

The invention will now be described in detail with reference to the embodiments shown in the drawings.

FIG. 1 is a plan view showing an ink jet recording apparatus, which is an embodiment of the invention. In FIG. 1, reference numeral 1 denotes a carriage, one end of which is connected to a timing belt 4 through a coupling member 2 and the other end of which is supported by a guide member 6 of a frame body 10 through a sliding member 5. The timing belt 4 is driven by a motor 3. This carriage 1 can reciprocate across the width of a recording sheet.

A black ink recording head for printing is fixed to the lower surface of the carriage 1. A subtank 7 that supplies ink from an ink cartridge 11 (to be described later) to the black ink recording head and an optional releasable color ink print unit 8 are mounted on the upper surface.

Ink cartridge 11, which accommodates an ink bag 12 made of an air-permeable flexible film in a hard case 13, has an ink supply port 14 in one end thereof. The ink cartridge 11 and a subtank 7 are connected to each other through a tube 16 that is protected by a flexible case 15, part of the flexible case 15 being made of a coil spring so that the ink in the ink bag 12 is supplied to the subtank 7 by a pump (not shown). As a result, the ink can be supplied to the black ink recording head while maintaining the water head at a reasonable fixed level.

Carriage 20 is large enough to cover a print region. On the surface of the carriage 20 are sheet forward rollers 21 and sheet discharge rollers 22. The sheet forward rollers 21 forward a recording sheet to a print region from a sheet feed cassette (not shown) and are arranged in the rear (above as viewed in FIG. 1). The sheet discharge rollers 22 guide the printed portion of the recording sheet and are arranged in the front (below as viewed in FIG. 1). Further, a capping device 33 is arranged in an area to which the carriage is evacuated during stoppage. The capping device 33 has a cap member 31 that seals a color ink recording head and a cap member 32 that seals the black ink recording head.

The ink discharge hole 35 is arranged in a nonprint region opposite to the side where the capping device 33 is arranged as well as at such a position as to cover the locus of movement of the black ink recording head. The ink discharge hole 35 has an ink absorbing member 36 therein.

Discharge ink tank 40 is constructed of a plurality of plates 41, each of the plates 41 being made of a porous material such as felt.

Figure 3:
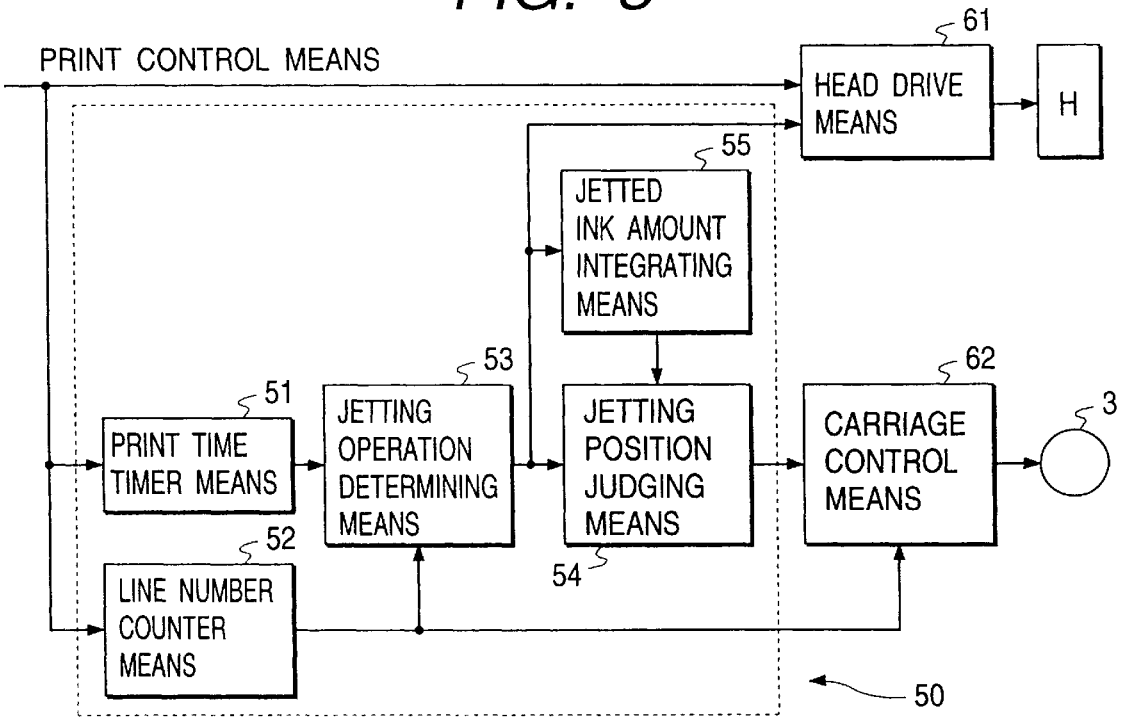
FIG. 3 is a diagram showing a construction of a control means of the apparatus shown in FIG. 1.

FIG. 3 shows an exemplary controller 50 that controls flashing operation. The controller 50 includes: a print time timer means 51 that counts print time in response to a signal from a print control means (not shown); a line number counter means 52 that counts the number of printed lines; a jetting operation determining means 53 that judges whether or not the flashing operation is performed based on the data of the timer means 51 and the counter means 52; a jetting position judging means 54 that selects either the cap member 32 or the ink discharge hole 35 based upon the carriage 1 position at the time of performing the flashing operation and the integrated amount of ink jetted to the cap member; and a jetted ink amount integrating means 55 that integrates the amount of ink flashed to the cap member 32 and clears the integrated value every time a single recording sheet has been printed. The head drive means 61 causes the ink to be jetted from a recording head H in response to a print signal and a signal from the jetting operation determining means 53. The carriage control means 62 controls the operation of the carriage 1.

Figure 4:
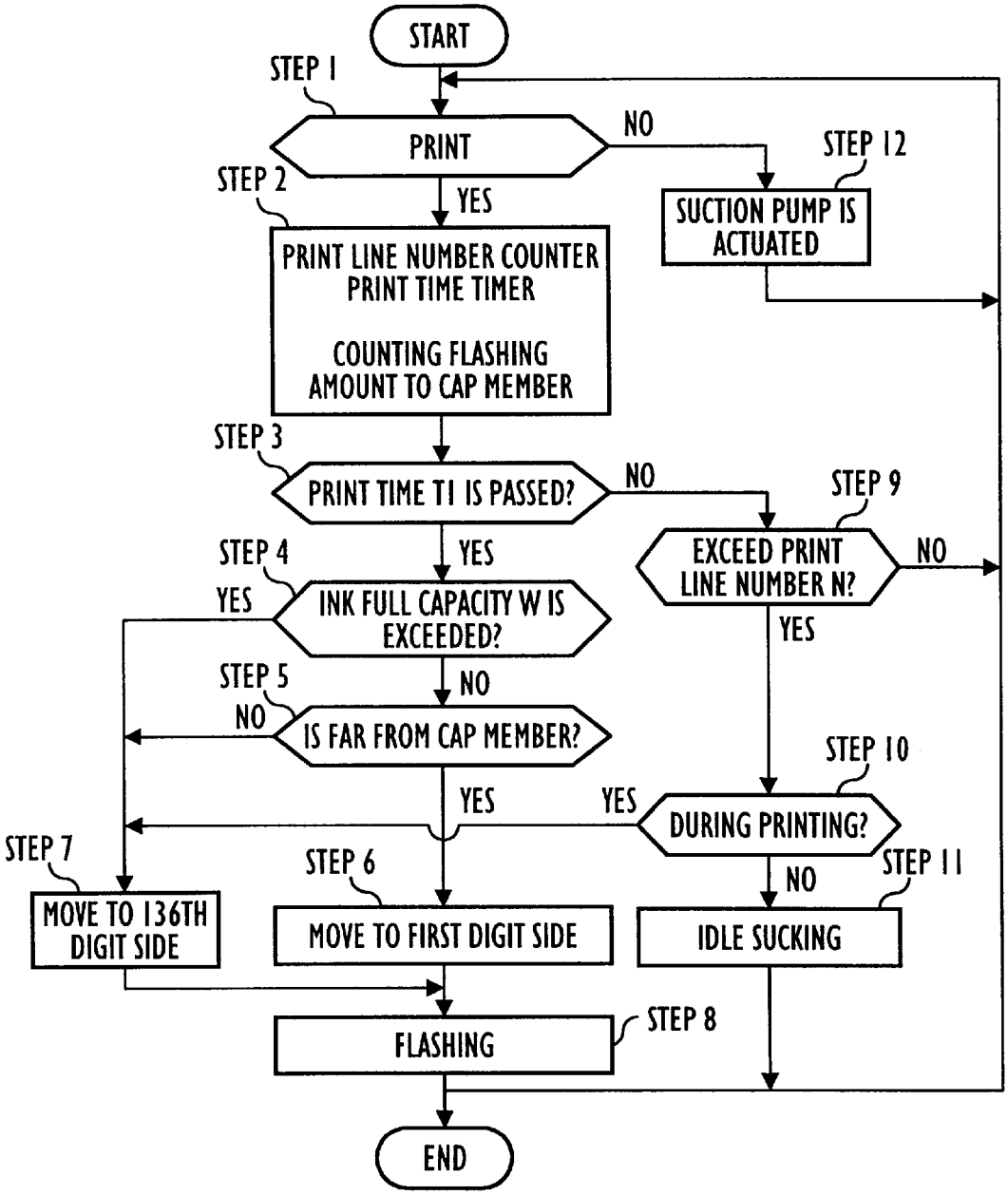
FIG. 4 is a flowchart showing an operation of the apparatus shown in FIG. 1.

An operation of the thus constructed apparatus will be described with reference to a flowchart shown in FIG. 4.

Upon start of the print operation (Step 1), the number of lines to be printed is counted by the print line number counter means 52, the print time is counted by the print time timer means 51, and the amount of ink flashed to the cap member 32 is monitored by the jetted ink amount integrating means 55 (Step 2).

If the value indicated by the print time timer means 51 has exceeded a predetermined time T1, e.g., 20 seconds, then a flashing operation command is given by the jetting operation determining means 53 (Step 3).

Being immediately after the start of the print operation, the ink is not yet filled up in the cap member 32 and therefore the ink in the cap member 32 does not exceed a full capacity W thereof (Step 4). Hence, the jetting position judging means 54 judges whether or not the carriage 1 position is close to the cap member 32, i.e., to the first digit side, or close to the ink discharge hole 35, i.e., to the 136th digit side (Step 5). The judging means 54 then causes the carriage 1 to move to the closer side (Steps 6, 7) and causes the ink to be jetted from the recording head H to either the cap member 32 or the ink discharge hole 35 (Step 8). For the flashing operation to the ink discharge hole 35, the ink can be jetted while the carriage 1 is being moved since the receiving port of the ink discharge hole 35 is larger than that of the cap member 32. As a result, the carriage 1 can be returned smoothly, which in turn contributes to improving throughput.

When the flashing operation has been performed to the cap member 32, the jetted ink amount integrating means 55 integrates the amount of ink jetted in terms of the number of ink droplets. The print time timer means 51 clears the timer content every time the flashing operation is performed before resuming the operation thereof (Step 2).

When the integrated value of ink supplied to the cap member 32 does not exceed the prescribed value W and the flashing operation to the capping member 32 can still be performed, the flashing operation can be effected either at the ink discharge hole 35 or at the cap member 32 that is closer to the carriage 1. Hence, the carriage 1 moving time for flashing can be reduced.

Further, if the number of print lines indicated by the line number counter means 52 has exceeded a predetermined number N (Step 9), and if the print operation for a single page has not yet been completed, then "batch flashing" is effected (Step 8) by moving the carriage 1 to the ink discharge hole 35 (Step 7), instead of the so-called "idle sucking" in which the cap member 32 is brought into contact with the recording head H and the ink is forcibly jetted while receiving negative pressure from the pump. As a result, the cap member 32 can contain an adequate amount of ink, and banding attributable to backlashes caused by reverse rotation of the sheet forward motor during printing can be prevented.

When the integrated value of the amount of ink flashed to the cap member 32 exceeds the full ink capacity W of the cap member 32 by effecting the flashing operation either to the cap member 32 or to the ink discharge hole 35 every time the print time T1 elapses (Step 4), the jetting position judging means 54 causes the carriage 1 to move to the ink discharge hole 35 that is positioned at the 136th digit so that the flashing operation is performed without judging the carriage 1 position (Step 7).

As a result, the overflowing of the ink from the cap member 32 can be blocked, and banding due to reverse rotation of the sheet forward motor for blocking the overflowing of the ink can be prevented as well.

Upon the end of the printing for the first page (Step 1), the sheet forward motor is reversely rotated to operate the pump, and the ink contained in the cap member 32 is discharged to a waste ink tank 40 (Step 12) so that the apparatus gets ready for a next round of printing.

Further, if the number of printed lines exceeds the prescribed value N upon the end of the printing for the first page (Steps 9, 10), then idle sucking is effected (Step 11) to discharge the ink from the recording head H to the cap member 32 forcibly. In this case, since the ink in the cap member is discharged to the waste ink tank 40 by the pump, the content of the jetted ink amount integrating means 55 is cleared.

It may be noted that the ink is not necessarily jetted to the ink discharge hole 35 from the color ink jetting recording head since the cap member 31 for the color ink jetting recording head is much larger than the cap member 32 that seals the black ink recording head. Therefore, the ink flashed during printing can be satisfactorily contained in the cap member 31. However, in order to improve throughput, it is desired that the ink be jetted to either the member 31 or the member 35 that is closer to the carriage 1.

As described above, the invention is characterized in that an ink discharge hole having a window confronting a recording head is arranged in a nonprint region opposite to the side where a cap member is arranged and within a locus of movement of the recording head. The recording head is attached to a carriage that reciprocates across the width of a recording medium so that the recording head can be sealed in a nonprint region. The apparatus includes a cap member that receives ink droplets to be jetted for maintenance of the recording head during printing. The ink discharge hole can absorb much larger amounts of ink than a capping means, so the operation of reversely rotating the print mechanism drive motor during printing in order to suck the ink out into the cap member by flashing is not necessary. Thus, banding and sheet forward errors are prevented.

Further, the capping means and the ink discharge hole, both serving as ink receiving containers, are arranged on both ends of the print region. Therefore, the time required for moving the carriage can be reduced by selecting either one of the members that is closer to the carriage and performing the flashing operation to such selected member. As a result, throughput can be improved.

What is claimed is:

1. An ink jet recording apparatus comprising:

a carriage that reciprocates across a width of a recording medium;

a recording head for jetting ink droplets, said recording head being attached to said carriage and moving along with said carriage;

a cap member for receiving ink droplets from said recording head for maintenance of said recording head during printing;

an ink discharge hole, said hole having a window confronting the recording head and being arranged in a nonprint region on an opposite end of a reciprocating path of said carriage from said cap member and within a range of a locus of movement of the recording head, wherein an ink absorbing member is contained in said ink discharge hole; and means for selecting one of said cap member and said ink discharge hole based on a relative distance between the carriage and said cap member and between the carriage and said ink discharge hole when a print operation lasts a predetermined time.

2. An ink jet recording apparatus comprising:

a carriage that reciprocates across a width of a recording medium;

a recording head for jetting ink droplets, said recording head being attached to said carriage and moving along with said carriage;

a cap member for receiving ink droplets from said recording head for maintenance of said recording head during printing;

an ink discharge hole, said hole having a window confronting the recording head and being arranged in a nonprint region on an opposite end of a reciprocating path of said carriage from said cap member and within a range of a locus of movement of the recording head; and a controller comprising means for integrating an amount of ink droplets jetted by said recording head to the cap member for maintenance, wherein when an integrated value of ink jetted to said cap member exceeds a predetermined amount, said recording head jets ink droplets to said ink discharge hole to perform further ink jetting maintenance operations.

* * * * *